US005924491A

United States Patent [19]

Jordan, Jr. et al.

[11] Patent Number: 5,924,491

[45] Date of Patent: Jul. 20, 1999

[54] THRU-TUBING ANCHOR SEAL ASSEMBLY AND/OR PACKER RELEASE DEVICES

[75] Inventors: Henry Joe Jordan, Jr., Conroe; Patrick J. Zimmerman, Houston, both of Tex.

[73] Assignee: Baker Hughes Incorporated, Houston, Tex.

[21] Appl. No.: 08/888,149

[22] Filed: Jul. 3, 1997

[51] Int. Cl.[6] ..... E21B 23/02

[52] U.S. Cl. ..... 166/386; 166/117.6

[58] Field of Search ..... 166/117, 117.6, 166/117.7, 386, 242.7

[56] References Cited

U.S. PATENT DOCUMENTS

| | | | |
|---|---|---|---|
| 4,089,548 | 5/1978 | Gurley . | |
| 4,290,484 | 9/1981 | Beall et al. . | |
| 4,383,578 | 5/1983 | Baker | 166/386 X |
| 4,399,873 | 8/1983 | Lindsey, Jr. . | |
| 4,540,047 | 9/1985 | Akkerman | 166/117.5 X |
| 4,612,985 | 9/1986 | Rubbo et al. | 166/116 X |
| 4,726,421 | 2/1988 | Akkerman et al. | 166/117.5 |
| 4,971,365 | 11/1990 | Schultz . | |
| 4,993,493 | 2/1991 | Arnold | 166/117 |
| 5,518,072 | 5/1996 | McTernaghan | 166/242.7 X |

FOREIGN PATENT DOCUMENTS

| | | |
|---|---|---|
| 109541 | 5/1984 | European Pat. Off. . |
| 272770 | 6/1988 | European Pat. Off. . |

*Primary Examiner*—Frank Tsay
*Attorney, Agent, or Firm*—Rosenblatt & Redano P.C.

[57] ABSTRACT

A configuration is provided to anchor the tubing string into a polished-bore receptacle while providing the ability to disconnect the tubing string from the polished-bore receptacle in a single trip in the wellbore. The configuration of the anchor provides for metal-to-metal sealing, and the disconnection is accomplished by a penetrating tool which accesses an annular cavity to unsupport locking dogs which facilitate removal of the tubing string from the polished-bore receptacle with applied pressure. If the packer needs to come out for any reason, a retrieving tool is described which, in a single trip, allows the retrieving tool to be advanced thru-tubing into the packer itself to unlock it. The retrieving tool is pulled out of the tubing and a pick-up force is applied to the tubing string to extend the packer to allow for its ultimate removal with the tubing.

18 Claims, 8 Drawing Sheets

THRU-TUBING ANCHOR SEAL ASSEMBLY AND/OR PACKER RELEASE DEVICES

FIELD OF THE INVENTION

The field of this invention relates to streamlined techniques for removal of an anchor seal assembly from a packer/PBR and/or releasing a packer through tubing to facilitate further downhole operations.

BACKGROUND OF THE INVENTION

The traditional methods of attaching the tubing string to a production packer or other completion equipment rely on devices known as seal assemblies. These assemblies allow the production tubing to maintain a continuous sealing conduit for the purpose of oil and gas production up the inside of the tubing and further allow the ability to disconnect the tubing when desired. The seal assemblies are normally connected to the packer in one of two ways, floating or anchored.

The floating seal assembly, also known as a locator seal assembly, is designed to allow for thermal expansion and contraction of the tubing without adding high stress to the tubing string. The seal assembly simply floats in a polished-bore receptacle (PBR) during the production life of the well.

It is more often desirable to anchor the tubing to the packer completion to ensure tubing stability. This is particularly true in the case of some deep water completions where a tension leg platform is used. For safety reasons, if a surface failure occurs, such as the platform floats off location and pulls an extreme tension load on the well, the desire is to have the tubing resist this tension by staying anchored to the completion packer. Therefore, the anchor seal assembly is attached to the packer via a threaded connection. Typically, the anchor seal assembly is removed from the packer by means of rotation at the surface or shear release. However, most deepwater completion designs have a significant number of control lines strapped to the outside of the tubing string. Some of these wells are highly deviated, making rotation difficult.

The current method of releasing an anchor in this type of completion is to run through the tubing with an internal tubing cutting assembly to a location just above the anchor seal assembly and cut the tubing completely through. The tubing is then removed. A second trip is then made with a work string to grapple and rotate the anchor out of the completion packer. Once the anchor is removed, a packer retrieving tool can be run to depth to recover the packer. This procedure requires a minimum of three round trips and is very expensive. Rig time in deepwater completions can run over $150,000 per day. Often, several days may be needed to recover the packer in this traditional manner.

In other situations, there arises a need to pull the tubing with the packer to facilitate further downhole operations. This is to be contrasted with dealing with a situation such as a leak in the tubing above the packer, which would not require the removal of the packer. In situations where not only the tubing needs to come out but the packer as well, the prior technique involved going thru-tubing with a tubing cutter to cut the tubing and retrieve the portion of the tubing above the cut. A second trip was required to remove the anchor for the tubing in the packer, and then a third trip was required back into the hole with a retrieving tool so that the packer could be retrieved. The retrieving tool had to be a specific length and have a defined latch to mate up with the packer receptacle assembly which is in the hole. The third trip would involve moving a support ring out from under a collet assembly on the packer, which unlocks the slips and sealing element of the packer and enables the tool to be retrieved with a pulling force.

Thus, in both situations the objective is to be able to accomplish the removal of the tubing only or of the tubing and the packer in fewer trips in the wellbore, thus saving rig time.

Hydraulic release mechanisms, as between the packer and the tubing, have been used in the past. However, the disadvantage of such designs is that they created leak paths between the tubing and the annulus if any of the various O-rings that are required in such designs malfunction. Thus, what is needed is a design which does not have the limitations of hydraulic release techniques as between the tubing and the packer; one such design provides for metal-to-metal sealing components. Thus, one of the objectives of the present invention is to provide a design which does not have the potential leak paths yet at the same time allows for simple separation of the tubing from the PBR without any need for twisting or turning. The objective is met with a design that allows, in a single trip in the hole, the actuation of the release mechanism to separate the anchor seal assembly from the PBR via an internal punch tool. Alternatively, the packer can be released thru-tubing with a retrieving tool which can go thru-tubing to the packer and act on its release assembly and following the operation, be readily removed. With the packer released, it can then be retrieved as the tubing is pulled out of the hole, thus eliminating the time required to pull the tubing to retrieve the packer.

SUMMARY OF THE INVENTION

A configuration is provided to anchor the tubing string into a polished-bore receptacle while providing the ability to disconnect the tubing string from the polished-bore receptacle in a single trip in the wellbore. The configuration of the anchor provides for metal-to-metal sealing, and the disconnection is accomplished by a penetrating tool which accesses an annular cavity to unsupport locking dogs which facilitate removal of the tubing string from the polished-bore receptacle with applied pressure. If the packer needs to come out for any reason, a retrieving tool is described which, in a single trip, allows the retrieving tool to be advanced thru-tubing into the packer itself to unlock it. The retrieving tool is pulled out of the tubing and a pick-up force is applied to the tubing string to extend the packer to allow for its ultimate removal with the tubing.

DETAILED DESCRIPTION OF THE PREFERRED EMBODIMENT

Figure 1:
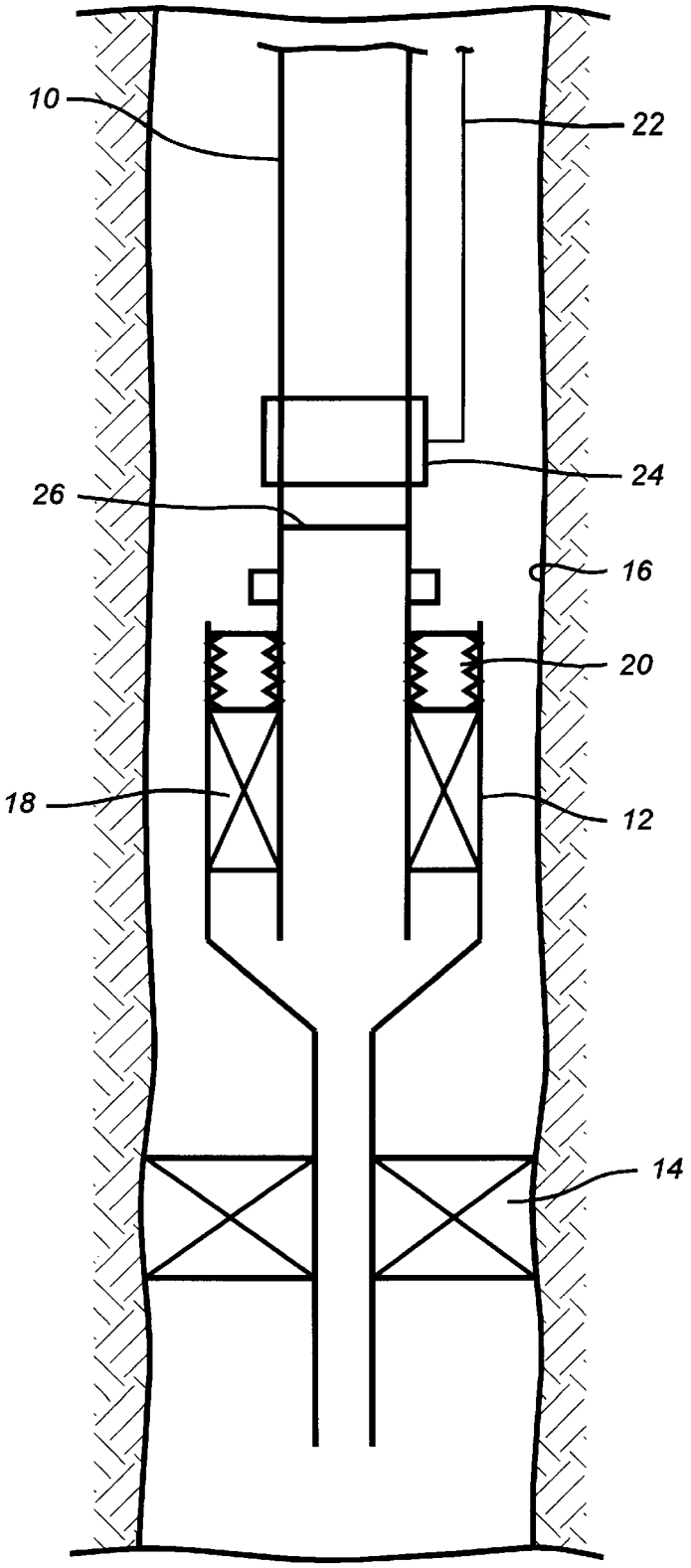
FIG. 1 is a schematic representation of an assembly showing a downhole packer, a polished-bore receptacle, and a tubing string with various control lines schematically attached to it.

Referring to FIG. 1, a tubing string 10 extends form the surface into a polished-bore receptacle (PBR) 12, which is a part of the structure of the packer 14. The packer 14 seals off the wellbore 16. The tubing string 10 has a seal 18 which is in contact with a seal bore inside the PBR 12. An anchor assembly 20 secures the tubing string 10 to the PBR 12. Typically, the tubing string 10 has a series of control lines 22 which are secured by guides 24 at intervals along the tubing string 10. The presence of the control lines 22 with guides 24 precludes a twisting motion as the means to release the anchoring assembly 20. Thus, in the past, cutting tools have been lowered through the tubing string 10 and a cut 26 was made with that tool. The portion of the tubing string above the cut 26 is then removed from the wellbore after the cutting tool is removed. Thereafter, a fishing operation with an overshot or a grappling device is required to latch onto the remainder of the tubing string 10 at cut 26 to provide the requisite rotation to release the remainder of the tubing string 10 from the PBR 12. It should be noted that once the upper portion of the tubing string 10 with the control lines 22 has been removed, a twisting motion is possible on the balance of the tubing string 10 still secured by the anchor assembly 20. If thereafter in the past the packer needed to come out, a separate trip was made after pulling out the balance of the tubing string 10 with a release tool for the packer 14 so that it could then be pulled out. These techniques previously used to either disconnect the tubing string 10 from the packer 14, or to pull out both the tubing string 10 and the packer 14, necessitated numerous trips into the wellbore and, consequently, consumed considerable time which results in expense to the operator who pays for the rig by the day. The cutting technique has created problems because of difficulties in making the cut or presentation of a rough edge which at time was difficult to grapple.

The apparatus and methods of the present invention are designed to streamline the process of either removing the tubing 10 from the PBR 12 and leaving the packer 14 intact, or alternatively, releasing the packer 14 without cutting the tubing 10. In either event, the operations are accomplished with a single trip in the wellbore. Additionally, the configuration as described in FIGS. 1–6 has the additional advantage over hydraulic release techniques in that metal-to-metal seals are used, as will be described below. Thus, the leak paths that exist through the tubing into the annulus in typical hydraulically operated devices are not present in the apparatus and method of the present invention.

Figure 2A:
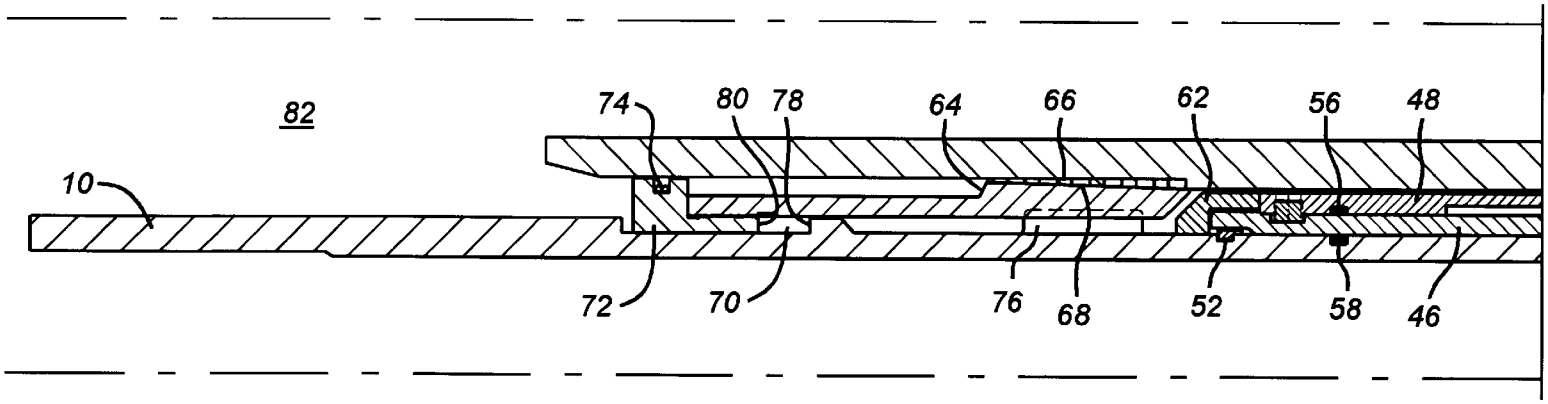
FIGS. 2*a*–2*b* illustrate the anchor seal assembly in the polished-bore receptacle, showing how the tubing string is anchored to the polished-bore receptacle.
Figure 2B:
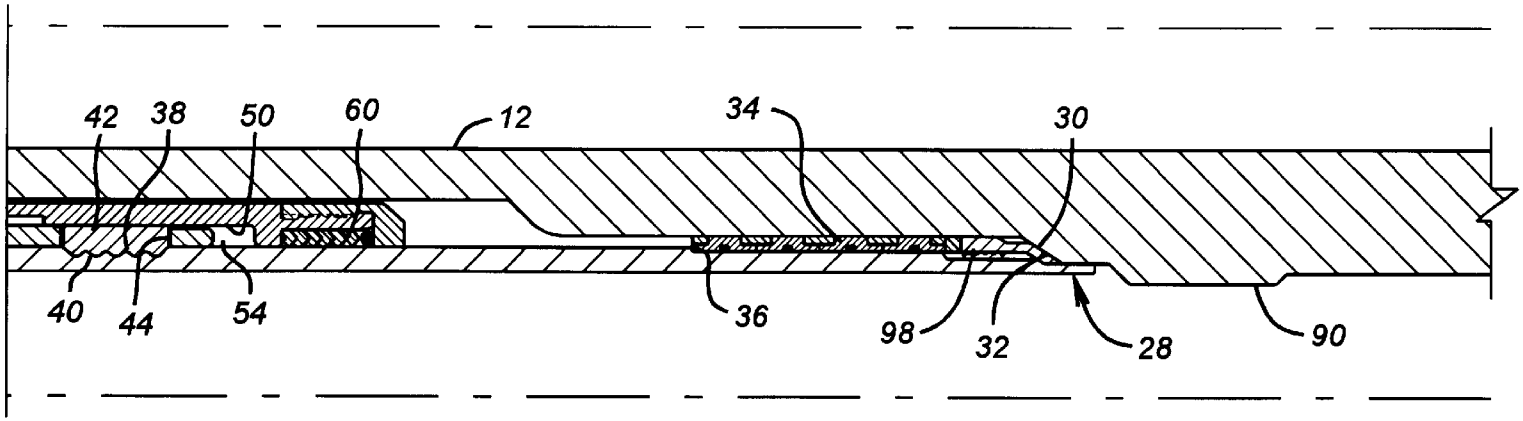

Referring to FIGS. 2*a*–2*b*, the PBR 12 is illustrated, as is the lower end of the tubing string 10. The tubing string 10, at a lower end 28, has a metallic sealing surface 30 which engages the sealing surface 32 of the PBR 12. Additionally, a backup seal ring 34 backs up the metal-to-metal seal between surfaces 30 and 32. Seal ring 34 can be a composite structure made of a plurality of elastomeric seals. The assembly 34 is retained between the ring 98 and the shoulder 36 on tubing string 10.

Also located on tubing string 10 is a series of serrations 38 which are designed to receive teeth 40 of dog or dogs 42. Dogs 42 extend through an opening 44 in sleeve 46. In the run-in position shown in FIG. 2*b*, the piston 48 has a surface 50 which contacts the dogs 42 to support them in the position where the teeth 40 extend into the serrations 38. The sleeve 46 is also secured to the tubing string 10 at shear ring 52. A cavity 54 is defined between the tubing string 10 and the piston 48 and is sealed by seals 56, 58, and 60.

Mounted above sleeve 46 is ring 62. Ring 62 ultimately contacts locking collets 64 which have a serrated surface 66 to interact with a similar surface 68 on the PBR 12. The collets 64 are retained within recess 70 of the tubing string 10. A top ring 72 engages the PBR 12, and seal 74 seals off the connection. The nature of the surfaces 66 and 68 permits insertion of the lower end 28 into the PBR 12 but does not permit removal because a support 76 allows assembly by a latching action but does not permit release. Ultimately, the support 76 is translated due to relative movement between the tubing string 10 and the collets 64, as shown by a comparison of FIGS. 5*a* and 6*a* so that a release is possible. The release is made possible by a breakage of the shear ring 52, which allows the tubing string 10, when picked up, to bring shoulder 78 against surface 80 of top ring 72. When that position is attained, as shown in FIG. 6*a*, the support 76 is moved over sufficiently so as to allow flexing of collets 64 sufficiently to allow relative movement of serrated surfaces 66 and 68.

Those skilled in the art will appreciate by looking at FIGS. 2*a* and 2*b* that surfaces 30 and 32 form a metal-to-metal seal, backed up by seal ring 34. Accordingly, there are no elastomeric seals which can be leak paths from the tubing 10 into the annulus 82. This provides a distinct advantage over hydraulically releasable systems which generally have hydraulically actuated pistons and flowpaths sealed off by a variety of elastomeric O-ring seals. Here, until penetrated, the cavity 54, with its various seals 56, 58, and 60, are all isolated from the flowpath inside of the tubing string 10. All those elastomeric and other types of seals are behind the metal-to-metal seal formed by surfaces 30 and 32.

Figure 3A:
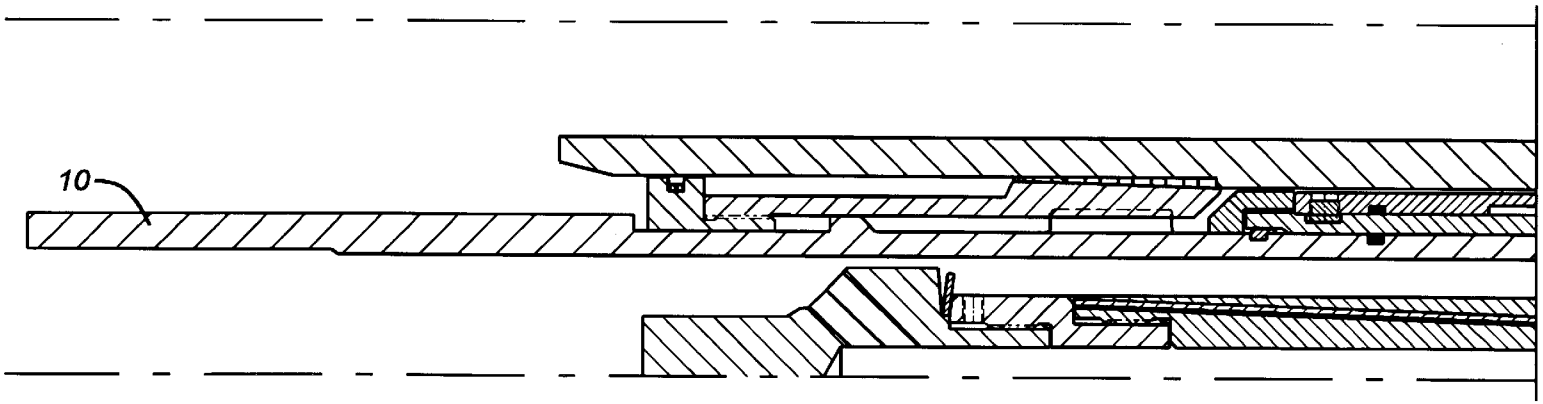
FIGS. 3*a*–3*b* are the view shown in FIGS. 2*a*–2*b,* with the penetrating tool in position prior to penetration.
Figure 3B:
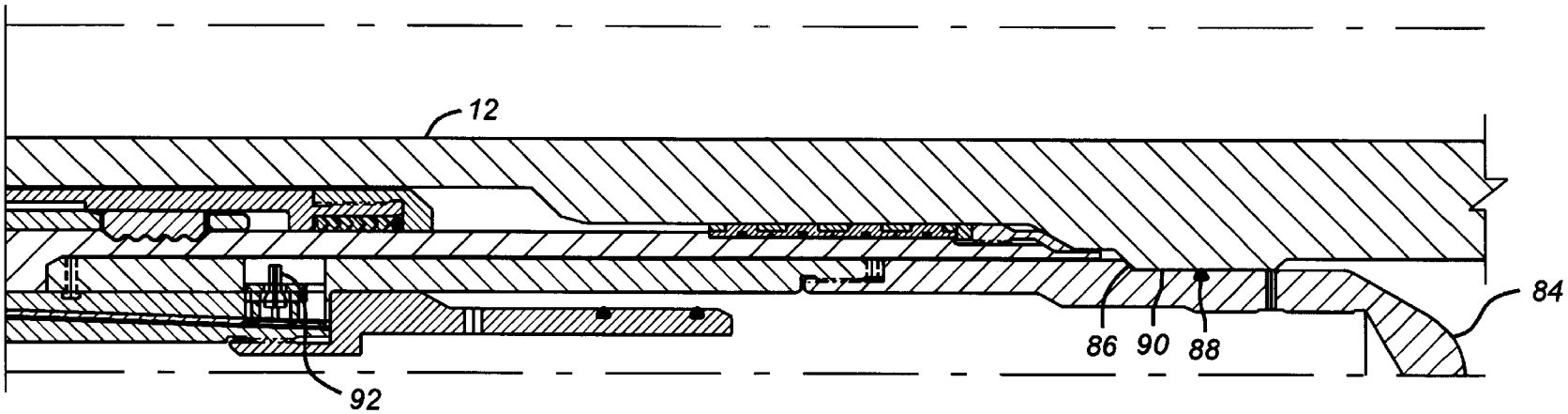
Figure 4A:
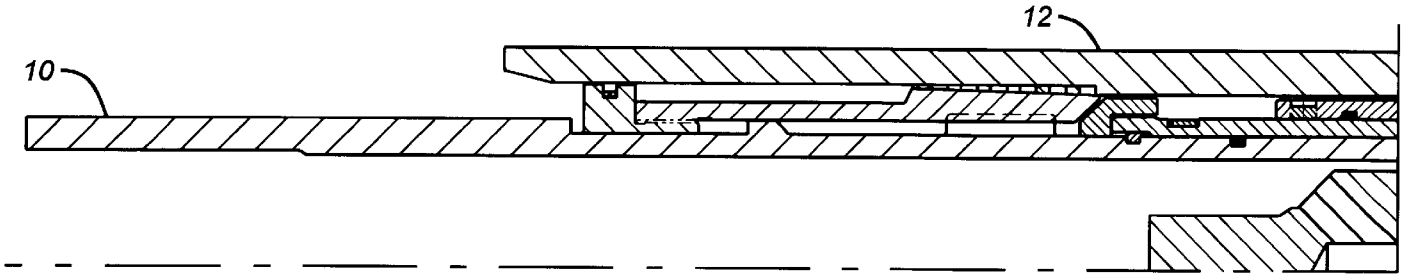
FIGS. 4*a*–4*b* illustrate the penetrating tool penetrating through the wall of the tubing and hydraulic pressure applied within the tubing to stroke a piston to unsupport the locking dogs.
Figure 4B:
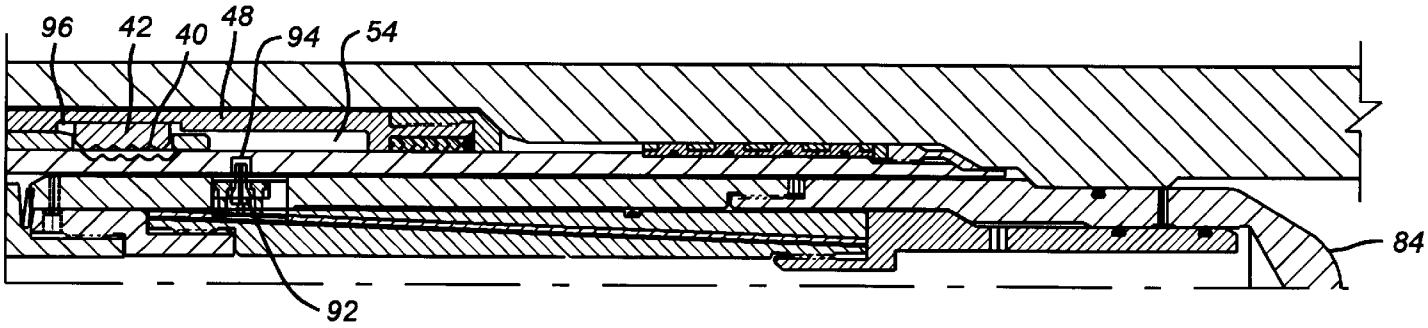

The tubing string 10 in FIGS. 2*a* and 2*b* is retained to the PBR 12 by virtue of the dogs 42 extending partially out of opening 44, thus locking the sleeve 46 to the tubing string 10. The sleeve 46 is also retained to the tubing string 10 by shear ring 52. Until the dogs 42 retract, there is no way to shear the shear ring 52. The collets 64 keep the entire assembly from coming out so long as they are supported by support 76. Thus, the release sequence cannot be initiated until the tubing string 10 has been penetrated into the cavity 54, as shown in FIGS. 3*b* and 4*b*. In FIGS. 3*a* and 3*b*, the puncture tool 84 is inserted into the tubing string 10 and landed on shoulder 86. When this occurs, seal 88 comes into contact with surface 90 on the PBR 12, effectively closing off the tubing string 10 internally to permit pressure build-up therein for actuation of the puncture tool 84. The puncture tool 84 is a tool of the type that is well-known in the art. Upon an application of a downward force, the punch 92 moves radially due to a wedging action until it creates an opening 94 into cavity 54, as shown in FIG. 4*b*. Application of pressure moves the piston 48. At this time, the sleeve 46 is still locked to the tubing string 10 at shear ring 52. Movement of the piston 48 presents recess 96 opposite the dogs 42 to allow them to retract within sleeve 46, thus retracting teeth 40 from the serrations 38 in the tubing string 10. This condition is shown in FIG. 4*b*, with the piston 48 fully stroked.

Figure 5A:
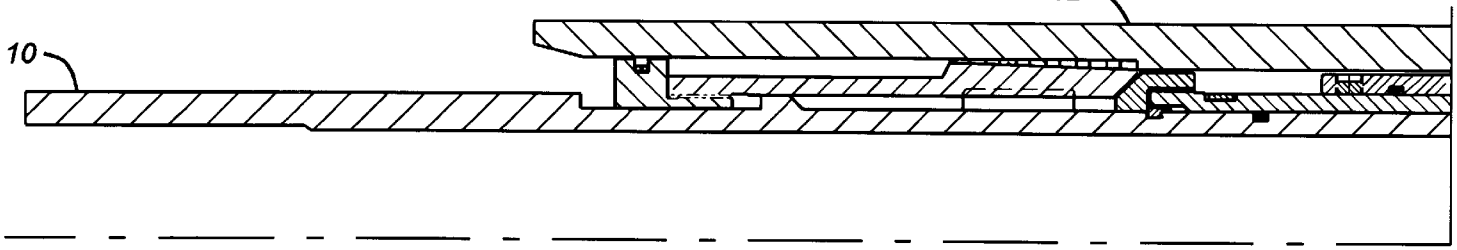
FIGS. 5*a*–5*b* illustrate the connection previously shown in the figures, with the penetrating tool removed and a shear ring about to shear.
Figure 6A:
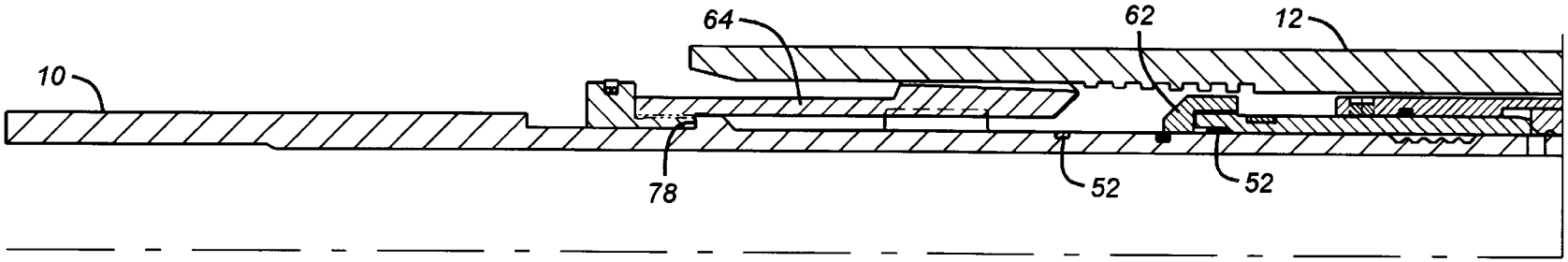
FIGS. 6*a*–6*b* illustrate the shear ring in a broken position and the tubing movable out of the polished-bore receptacle.
Figure 5B:
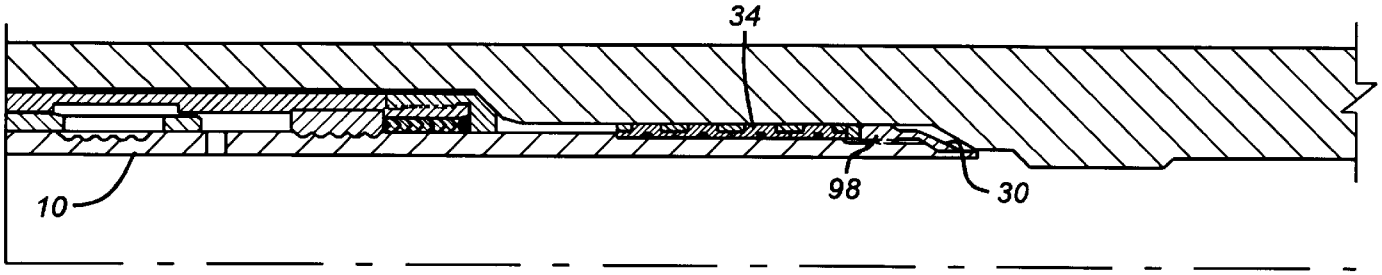
Figure 6B:
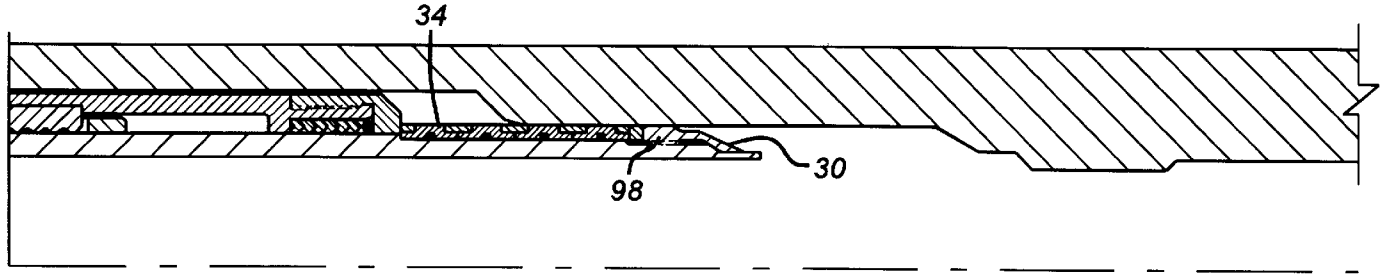
Figure 7A:
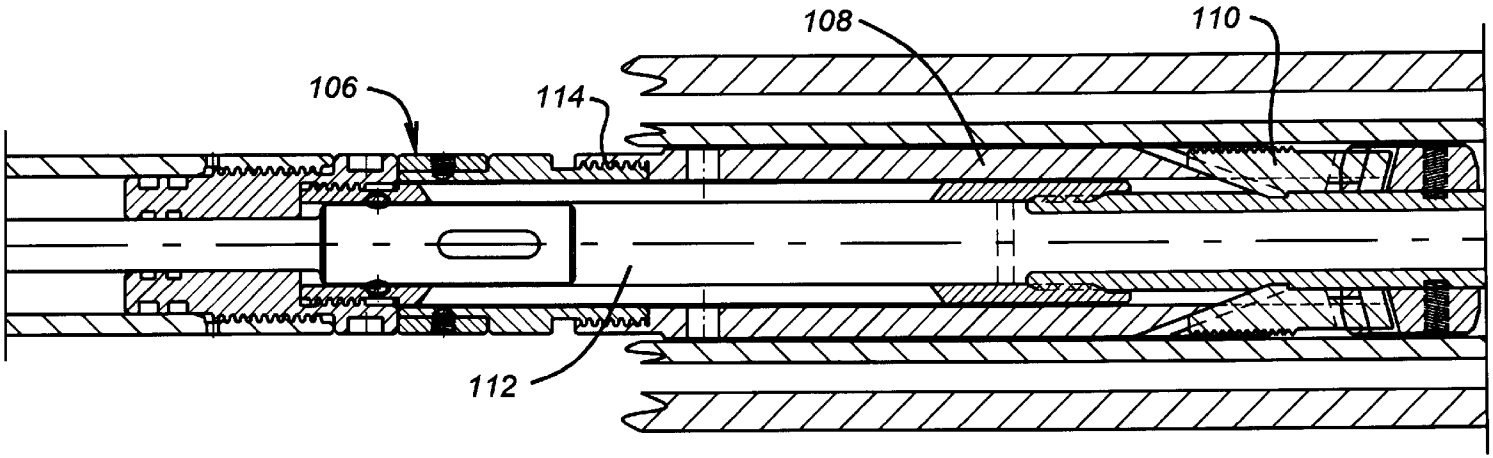
FIGS. 7*a*–7*c* illustrate the thru-tubing release tool for the packer mounted below the polished-bore receptacle in the run-in position just prior to a packer release.
Figure 7B:
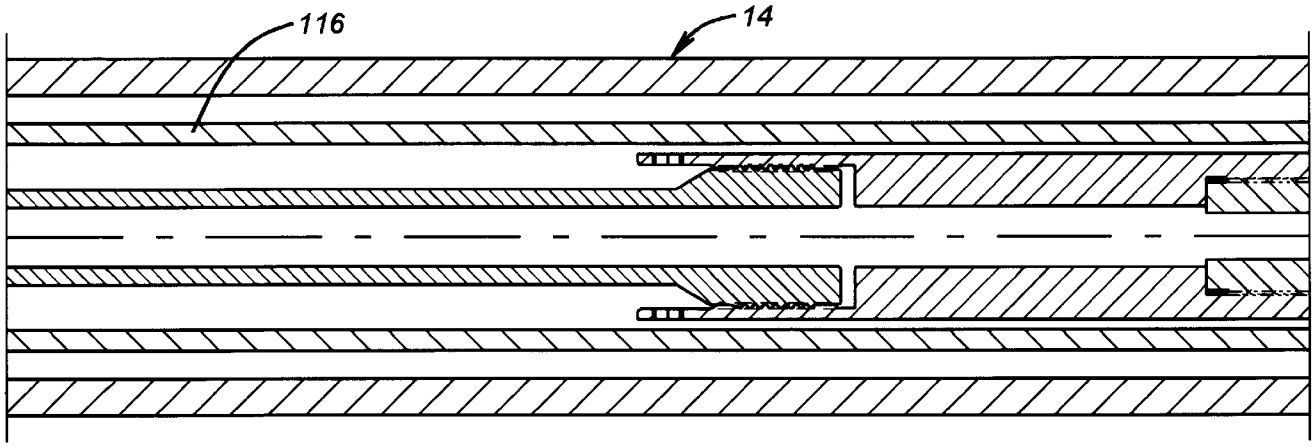
Figure 7C:
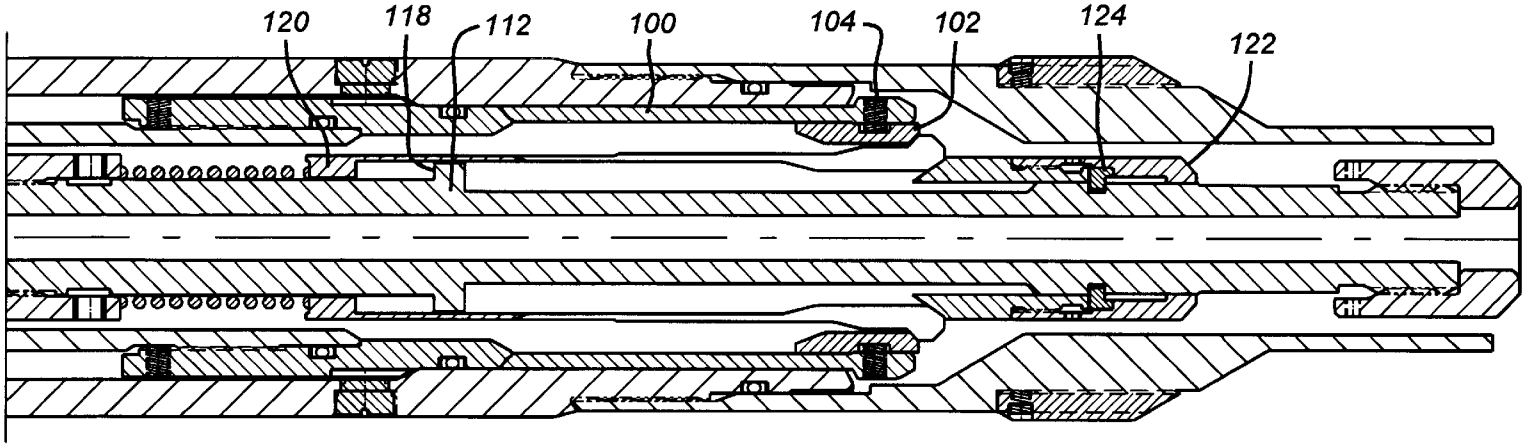

The puncture tool 84 is removed, as shown in FIGS. 5*a* and 5*b*, and the pickup force is applied to the tubing string 10. Eventually, ring 62 contacts collets 64 and a further upward pull on the tubing string 10 breaks shear ring 52. The tubing string 10 can then move up further as shoulder 78 approaches surface 80 on top ring 72. A continuing upward pull on the tubing string 10 releases the serrated surfaces 66 and 68 due to movement of the support 76 out from under the collets 64. The entire assembly can then be removed, as shown in FIGS. 6*a* and 6*b,* as the shoulder 78 carries with it the collets 64 while the assembly of piston 48 and sleeve 46 rides down to the seal ring 34. Seal ring 34, and the assembly that rests on top of it during the movement of FIG. 6, are caught by ring 98, which supports the seal ring 34.

Those skilled in the art can appreciate that, with a single trip downhole with the puncture tool, access is provided into cavity 54, and a subsequent pressurization strokes the piston 48 to unlatch the dogs 42 which have been holding the sleeve 46 to the tubing string 10. With the dogs 42 engaged, there is no way to break the shear ring 52. However, with the dogs 42 disengaged after a puncture operation, a pickup force can then shear ring 52 to allow a release of the collets 64 and removal of the tubing string 10 from the PBR 12. In the meantime, until a puncture opening 94 is made, the tubing string 10 is held to the PBR 12 with a metal-to-metal seal of surfaces 30 and 32.

Situations in a well can arise where it is necessary to not only remove the tubing string but also the packer. In the assembly shown in FIG. 1, as previously described, prior techniques precluded twisting of the tubing string 10 due to the presence of the control lines 22. Accordingly, a multi-step process was necessary in order to first gain sufficient access with a known release tool to go into the packer 14 to release it. The lower end of a known packer 14 is illustrated in FIGS. 7*a*–7*c* and 8*a*–8*c*. The set of such a packer 14 is held by a series of collets 100 which are retained by a ring 102, held to the collets 100 by shear pin or pins 104. In the past, the tubing string 10 had to be fully removed so that the release tool could go through the PBR 12 into the packer 14 and latch onto ring 102 to break shear pin 104, thus allowing the packer 14 to be withdrawn by an applied pickup force which would in turn stretch out the sealing elements (not shown) and the slips (not shown) which hold the packer 14 in the wellbore 16.

One of the aspects of the invention is to be able to run through the tubing string 10 without disconnecting it from the PBR 12 and reach the release components in the packer 14. The release components, as previously described, are the collets 100 held in position by ring 102. When ring 102 is moved to break shear pin 104, allowing the collets 100 to flex radially inwardly, an upward pull on the packer 14 results in stretching out of the packer 14 so as to release the sealing elements and slips (not shown) on the packer 14.

Figure 8A:
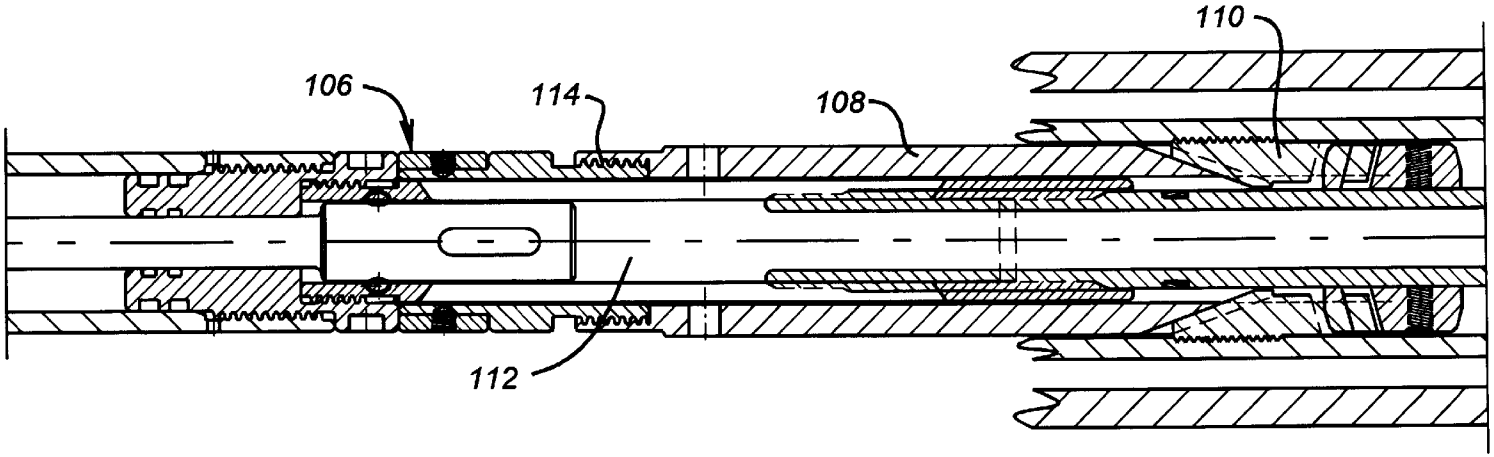
FIGS. 8*a*–8*c* illustrate the packer in a released position, with the release tool in a position for withdrawal from inside the tubing.
Figure 8B:
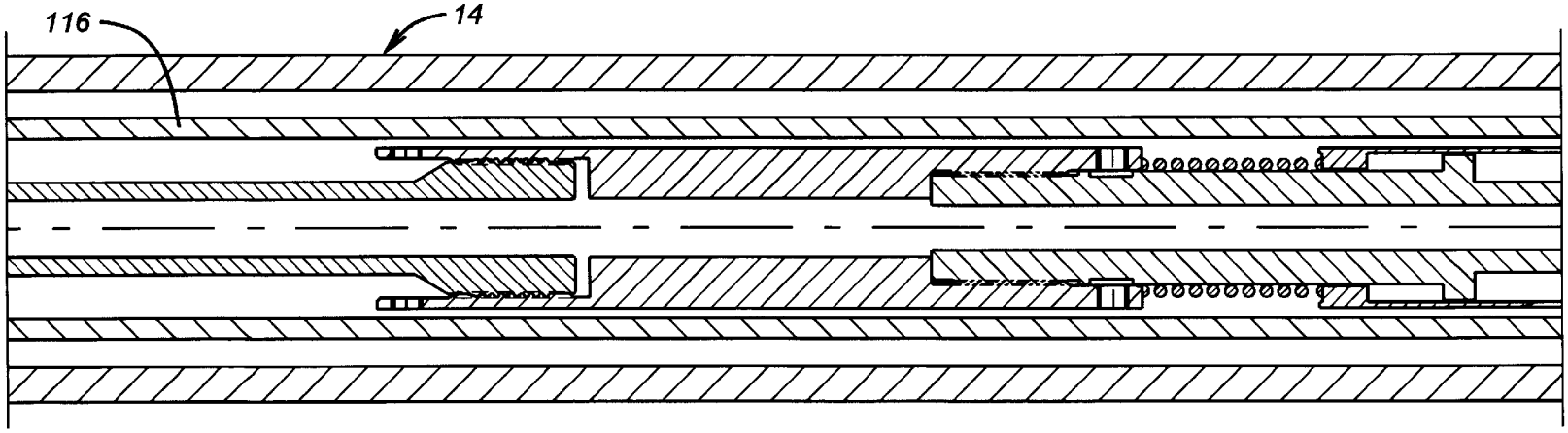
Figure 8C:
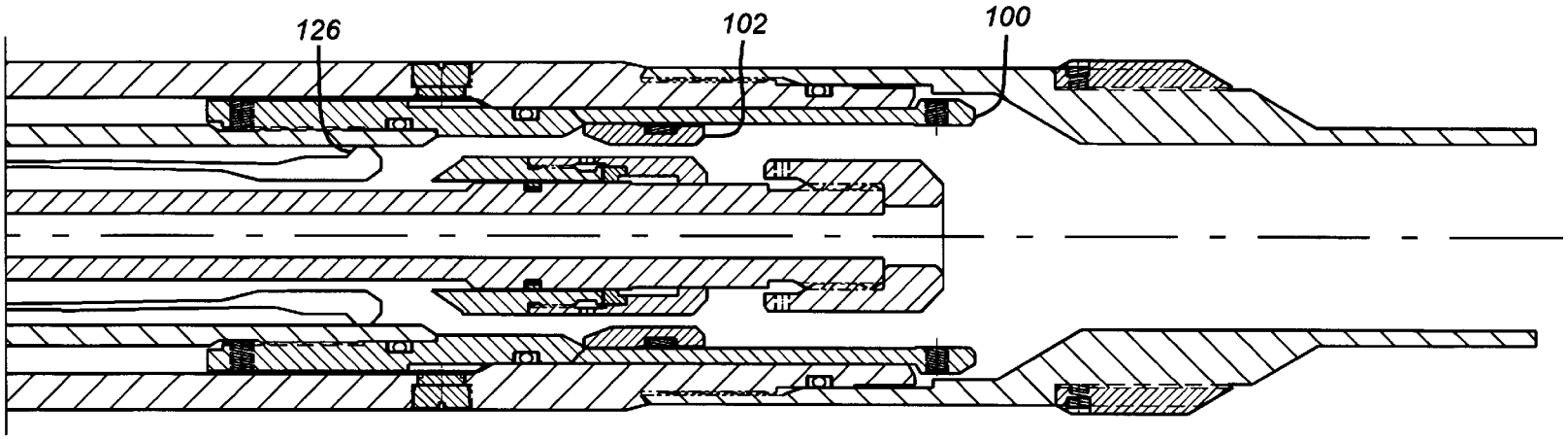

The invention comprises using a tool that can create relative motion, such as an E-4 setting tool made by Baker Oil Tools. This setting tool 106 is modified from the known design by the inclusion of a cone or cones 108 on which ride slips 110. The setting tool 106 is run in on electric line and when actuated, creates relative movement between a body 112 and an outer sleeve 114. The tool can be run in on coiled tubing or other means. Any tool that can engage the ring 102 and force it to move in a single trip is within the scope of the invention. Via an electric signal communicated from the surface, the tool 106 builds pressure so as to create initial downward movement of outer sleeve 114. That movement pushes the slips 110 against the cone 108 and anchors the outer sleeve 114 to the body 116 of the packer 14. With further downward movement of the outer sleeve 114 being arrested by the slips 110, then the body 112 of the tool 106 moves upwardly. The upward movement of body 112 causes shoulder 118 to engage collets 120. As the collets 120 move up, they pick up ring 102 and break shear pin 104, thus allowing the packer 14 to be withdrawn. On further upward movement of the body 112, ring 122, which had previously provided support for collets 120 to allow them to bear on ring 102 to break shear pins 104, becomes detached for slidable movement on body 112 as the shear ring 124 is broken. This can be seen by looking at FIG. 8*c*. The breaking of shear ring 124 allows ring 122 to slide downwardly so as to avoid any future reengagement of collets 120 against ring 102 after shear pin 104 has broken. Ring 102, as shown in FIG. 8*c,* cannot snag surface 126 of the collets 120. At the same time, with shear screw 104 broken, the collets 100 are free to move radially inwardly, as shown in the position of FIG. 8*c*. At this time an upward pull on the tool 106 brings the cone 108 up, which pulls back slips 110, allowing the tool 106 to be removed from the packer 14. After the tool 106 is removed, the tubing string 10, which is still connected at the PBR 12, is given an upward pull to stretch out packer 14, thus relaxing its sealing elements and slips (not shown). At this time, the tubing string 10 can be disassembled from the surface to bring the packer 14 up to the surface.

As shown in FIGS. 7*a*–7*c* and 8*a*–8*c,* if further operations in the wellbore require the packer 14 to be removed in a situation where the tubing string 10 is anchored to the PBR 12 and a rotational release is not possible for the tubing string 10, numerous trips into the wellbore are eliminated as, in a single trip, a tool enters the packer 14, actuates its release mechanism, and permits its subsequent removal so as to allow a pickup force at the surface applied thereafter to stretch out the packer and allow the removal of the string with the packer. Considerable rig time is saved from this one-trip procedure, resulting in substantial savings to the operator in rig time.

The foregoing disclosure and description of the invention are illustrative and explanatory thereof, and various changes in the size, shape and materials, as well as in the details of the illustrated construction, may be made without departing from the spirit of the invention.

We claim:

1. A one-trip method of releasing a tubing string having a flowpath therein and an anchor seal assembly which is securable to a downhole receptacle, comprising:

disposing the anchor seal assembly on the tubing string exterior behind a metal-to-metal seal which seals around the flowpath in the tubing string when inserted into the receptacle;

securing the anchor seal assembly to the receptacle due to said insertion;

releasing the tubing string from said securing in the receptacle in a single trip with a through-tubing tool.

2. The method of claim 1, further comprising:

engaging a release mechanism mounted on the exterior of the tubing and between the tubing string and the receptacle to release the tubing string from the receptacle.

3. The method of claim 2, further comprising:

creating access from the flowpath to the release mechanism with a through-tubing tool.

4. The method of claim 3, further comprising:

puncturing a hole in the wall of the tubing string with a puncture tool mounted in the flowpath;

providing flow communication from said flowpath through the hole into a sealed cavity formed on the exterior of the tubing.

5. The method of claim 4, further comprising:

locating a piston in the cavity;

applying pressure to the cavity to stroke the piston;

releasing a first lock holding a sleeve to the exterior of the tubing string as a result of stroking the piston.

6. The method of claim 5, further comprising:

positioning, as a result of stroking the piston, a recess on the piston opposite at least one dog, which by engagement of the piston previously held the sleeve engaged to the tubing string.

7. The method of claim 6, further comprising:

providing a second lock on the exterior of the tubing to selectively secure the sleeve to the tubing;

moving said sleeve in tandem with said tubing string due to the presence of a second lock between them.

8. The method of claim 7, further comprising:

engaging the anchor of the anchor seal assembly with the sleeve;

unlocking the second lock by a predetermined applied force to the tubing string;

moving a support previously engaging the anchor and mounted to the exterior of the tubing string away from the anchor to release the anchor.

9. The method of claim 7, further comprising:

breaking the second lock with applied shear force due to pickup of the tubing string with the sleeve being retained by the anchor.

10. The method of claim 4, further comprising:

sealing off the flowpath with the puncture tool;

mounting a piston in the cavity;

applying pressure to the cavity through the hole;

stroking the piston with the pressure applied;

removing the puncture tool.

11. A one-trip method of releasing a packer while connected to a tubing string, comprising:

running in a thru-tubing tool into the packer and through the tubing;

engaging a release ring in the packer with the tool;

bracing the tool;

creating motion with the tool to move the release ring;

picking up the tubing string to extend the packer from its set position.

12. The method of claim 11, further comprising:

bracing the tool to the packer by movement of at least a part of the tool in a first direction;

moving another part of the tool in a second direction opposite the first direction in order to move the release ring.

13. The method of claim 12, further comprising:

moving a slip with a cone mounted on one part of the tool as a result of the movement in a first direction;

moving a sleeve on the tool in contact with the release ring after the slip has gripped the packer.

14. The method of claim 13, further comprising:

using at least one collet on the tool to grab the release ring in the packer;

mounting the sleeve releasably on the tool;

backing the collet with the sleeve;

forcing the release ring to move using the collet backed by the releasable sleeve.

15. The method of claim 14, further comprising:

breaking a retainer holding the releasable sleeve to the thru-tubing tool;

allowing the releasable sleeve to shift;

preventing the collet from reengaging the release ring in a manner that would prevent removal of the thru-tubing tool.

16. The method of claim 15, further comprising:

running in the thru-tubing tool on wireline.

17. The method of claim 15, further comprising:

retracting the slip by applying an upward force to the cone to pull the thru-tubing tool out of the packer.

18. The method of claim 17, further comprising:

pulling the tubing out of the wellbore after removal of the thru-tubing tool;

removing the packer as a result of removing the tubing.

* * * * *